United States Patent [19]

Mahoney

[11] Patent Number: 4,931,842

[45] Date of Patent: Jun. 5, 1990

[54] COLOR COPIER WITH CONSTANT OUTPUT RATE

[75] Inventor: Gregory P. Mahoney, Fairport, N.Y.

[73] Assignee: Eastman Kodak Company, Rochester, N.Y.

[21] Appl. No.: 401,393

[22] Filed: Aug. 31, 1989

[51] Int. Cl.[5] ..... G03G 21/00

[52] U.S. Cl. ..... 355/317; 355/271; 355/309

[58] Field of Search ..... 355/271, 273, 282, 309, 355/313, 317, 282, 285; 271/182, 256

[56] References Cited

U.S. PATENT DOCUMENTS

| | | | |
|---|---|---|---|
| 4,235,431 | 11/1980 | Abrams et al. | 355/309 |
| 4,477,176 | 10/1984 | Russel | 355/271 |
| 4,712,906 | 12/1987 | Bothner et al. | 355/3 T R |
| 4,731,637 | 3/1988 | Acquaviva et al. | 355/317 |
| 4,849,795 | 7/1989 | Spehrley, Jr. et al. | 355/317 |

*Primary Examiner*—Fred L. Braun
*Assistant Examiner*—Susan D. Luddy
*Attorney, Agent, or Firm*—J. R. Hanway

[57] ABSTRACT

Apparatus and method for obtaining a constant copy output rate in color copiers having a transfer station which produces more than one color copy at substantially the same time. The time lapse between making another set of color copies, necessitated by transferring several color image frames in sequence, is utilized to provide the constant output rate. The sheet transport system between the transfer station and the fuser station is controlled such that it delivers the copy sheets to the fuser at time intervals different than that at which they are received from the transfer station. According to the preferred embodiment, the conveyor is stopped for a predetermined time between delivering each sheet to the fuser from the same set.

12 Claims, 2 Drawing Sheets

COLOR COPIER WITH CONSTANT OUTPUT RATE

BACKGROUND OF THE INVENTION

1. Field of the Invention

This invention relates, in general, to photocopying and, more specifically, to sheet transporting systems in copiers, printers, duplicators, and like devices.

2. Description of the Prior Art

Electrostatographic apparatus, such as copiers, printers, and duplicators, can have many different basic forms of construction. One type of apparatus known in the prior art has a transfer drum which is dimensioned to be able to hold two copy sheets at the same time. U.S. Pat. No. 4,712,906, which issued on Dec. 15, 1987 to the same assignee as the present invention, discloses such apparatus. In the referenced patent, the transfer drum can handle one 11"×17" copy sheet or two 8½"×11" copy sheets simultaneously. The ability to process two sheets at the same time increases the throughput speed of the machine when using the smaller sized sheets.

When color copying is employed, there is a gap between the times when copies are produced by the transfer station of the copier with either single or double sheet transfer. This gap is required because extra revolutions of the transfer drum are necessary to transfer all of the separate color images in registration to the copy sheets. Sometimes, as many as four revolutions are necessary to get all of the image frames transferred to a pair of 8½"×11" copy sheets. A subtle but nevertheless actual disadvantage of such a process is that the finished color copies are delivered to the machine fuser station at a non-constant rate when multiple copies of the original are being made with the multiple-sheet transfer system. This is an unusual occurrence to the operator and can cause some confusion as to when the copy operation is actually finished.

Many of the major subsystems in a copier or printer cannot change speed without affecting other characteristics of the machine's operation and performance. For example, if the speed of the fuser is changed, the amount of heat applied to the copy paper would be different than it is at the normal speed. To maintain consistency in the copies, a change in the temperature of the fuser would be needed with such a change in speed. Thus, changing the speed of the fuser is not usually desirable unless the amount of heat applied to the copy sheet can also be varied.

Therefore, in order to obtain a more expected and consistent output from a color copier or printer, it is desirable, and it is an object of this invention, to provide a control means for regulating the output rate at which copies are delivered by a machine which transfers to more than one color copy at a time.

SUMMARY OF THE INVENTION

There is disclosed herein a new and useful sheet transport system for use with printers, copiers, and like devices which have a transfer station where developed images are transferred to a copy sheet and a fusing station where the transferred images are fused to the sheet. The transport system includes a conveyor belt for moving copy sheets between the transfer station and the fuser station. The conveyor belt is stopped at predetermined intervals to maintain a constant copy delivery rate to the fusing station.

In a preferred embodiment of the invention, a two-up transfer system is used to make a plurality of color copies from an original document. With the two-up system, two copy sheets are produced by the transfer station in quick succession. Then, while the color image frames for the next set of two copies are being made and transferred, the output of copy sheets from the transfer station ceases. Instead of delivering the two copy sheets in each set to the fusing station at the same rate at which they are received from the transfer station, the sheet transport system of this invention stops for a predetermined time after delivering the first of the two copy sheets in the set. Then, the transport system starts running again to deliver the second sheet of the set to the fusing station. The predetermined time is about one-half the time which is required for the transfer station to acquire the transferred images for all of the colors before delivering another set of two copy sheets.

The timing control of the transport system disclosed herein can be used on any type of machine wherein the transfer station delivers copies at a non-constant rate. The enhancement provided by this system provides a more expected output rate from the machine and eliminates any confusion as to when the copy operation is finished or if there is a jam in the machine.

BRIEF DESCRIPTION OF THE DRAWINGS

Further advantages and uses of this invention will become more apparent when considered in view of the following detailed description and drawings, in which.

DESCRIPTION OF THE PREFERRED EMBODIMENTS

Figure 1:
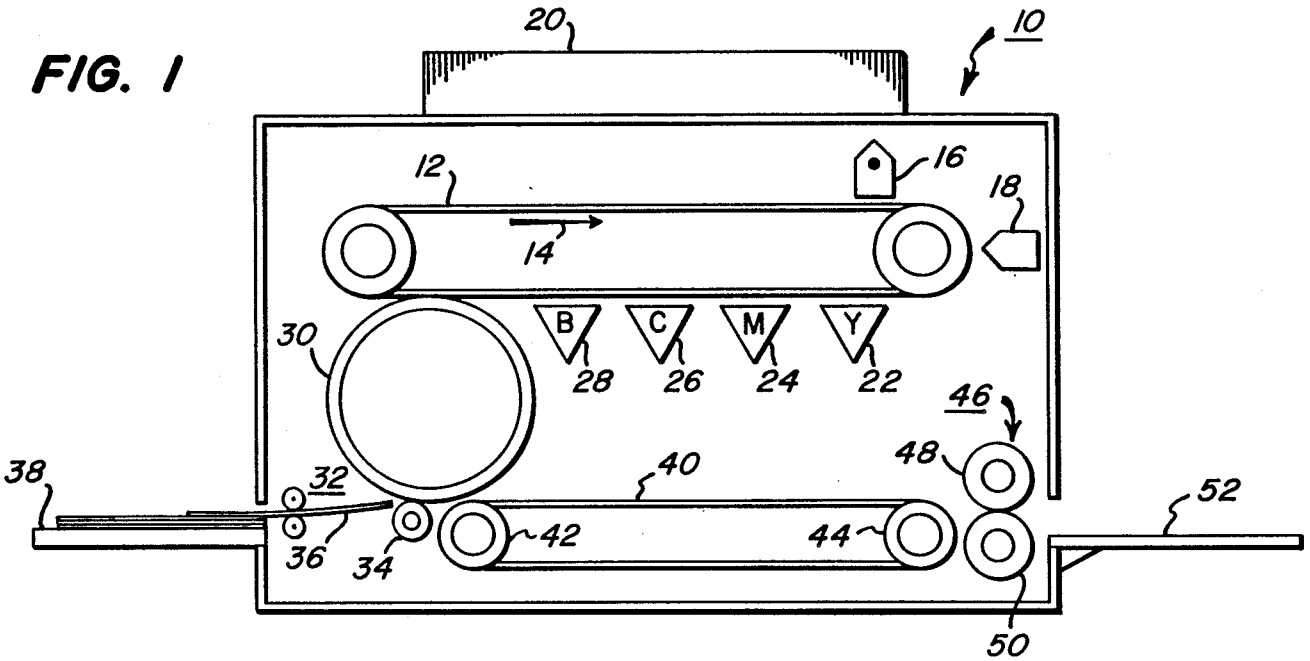
FIG. 1 is an overall schematic view of a copier wherein invention is applicable.

Throughout the following description, similar reference characters refer to similar elements or members in all of the figures of the drawings.

Referring now to the drawings, and to FIG. 1 in particular, there is shown an overall schematic view of a copier which can be adapted to use the invention. The copier 10 includes the photosensitive surface 12 which rotates in direction 14 around a pair of rollers. The primary charger 16 places a predetermined charge on the surface 12 and the printhead 18 is used to selectively expose the photosensitive member 12 with the image information obtained from the scanner 20. The latent images formed by the printhead 18 are developed by the toner stations 22, 24, 26 and 28 at the appropriate time. The developed images are transferred in sequence to the intermediate transfer drum or roller 30 in registration to form the composite image to be transferred to the copy sheet.

In order to form the composite image, several revolutions of the intermediate transfer drum 30 are required since the images of different colors are at different positions on the photosensitive surface 12. While the invention is described herein with the use of a copier having an intermediate transfer member, it is to be understood that the invention is equally applicable to copiers with direct transfer drums and to other electrostatographic apparatus such as printers, duplicators and like devices. Also, belts or webs may be used in place of the drums shown, and "rotation" as used herein also applies to the movement of such web surfaces.

During one mode of the transfer operation, images are transferred to two copy sheets in one revolution or cycle of the drum 30. During another mode of the transfer operation, no images are transferred to copy sheets during at least one cycle of the transfer drum. When making multiple copies, the transfer station alternates or interchanges between these two modes throughout the copy operation.

For the sake of being versatile and applicable to many copying operations, most copiers are capable of copying to more than one size of copy sheet. Usually, the copier can produce copies on paper or transparencies having a size range of at least 2 to 1. In other words, the copier shown in FIG. 1 would be capable of producing copies on 8½"×11" copy sheets or on 11"×17" copy sheets. The intermediate transfer drum 30 is sized or dimensioned appropriately to contain the composite image which will be applied to the larger sheet, which in this specific embodiment will be referred to as an 11"×17" sheet. When copying to the smaller sized sheets, the transfer drum can contain two composite images simultaneously which will be transferred to two successive 8½"×11" copy sheets. This type of transfer is known in the art as a two-up transfer system. Consequently, when running the smaller sized sheets, two images are delivered to the copy sheets in quick succession. It is emphasized that three-up, four-up, etc. transfer systems may be used in place of the two-up system described herein, and the invention described is also applicable to such systems.

The transfer station 32 includes the apparatus needed to transfer the developed images to the copy sheets. In this embodiment, the transfer station 32 includes the intermediate transfer drum 30 and the secondary transfer roller 34 which can be moved into and out of engagement with the transfer drum 30 for appropriate transfer control. As illustrated, a copy sheet 36 is removed from the tray 38 and directed to the area between the secondary transfer roller 34 and the transfer drum 30. As the sheet 36 passes between these two members, the registered composite image on the intermediate transfer drum 30 is transferred to the copy sheet 36. This sheet is immediately deposited on the conveyor belt 40 which extends around rollers 42 and 44.

The conveyor belt 40 is the primary transport system for the sheets coming from the transfer station 32 and going to the fuser station 46. When the transfer drum 30 is operating in the two-up mode, two sheets are applied in quick succession to the conveyor belt 40. Then, several revolutions of the intermediate transfer drum 30 are needed before any other sheets are delivered to the conveyor belt with images thereon. As already indicated, the additional time is required for the separate transfers of the developed images from the surface 12 to the intermediate transfer drum 30.

The fuser station 46 includes the fuser rollers 48 and 50. Once the copy sheets pass through the fuser station 46, they are deposited on the output tray 52. It is at this position that the operator running the copier is aware of the throughput speed or rate at which the copier is producing copies. Even though the copies in the two-up mode are provided at a non-constant rate from transfer station 32, it is desirable to have the copy sheets placed upon the output tray 52 at a constant rate. The invention, which will be described in more detail in connection with FIG. 2, provides the means for producing this result.

Figure 2:
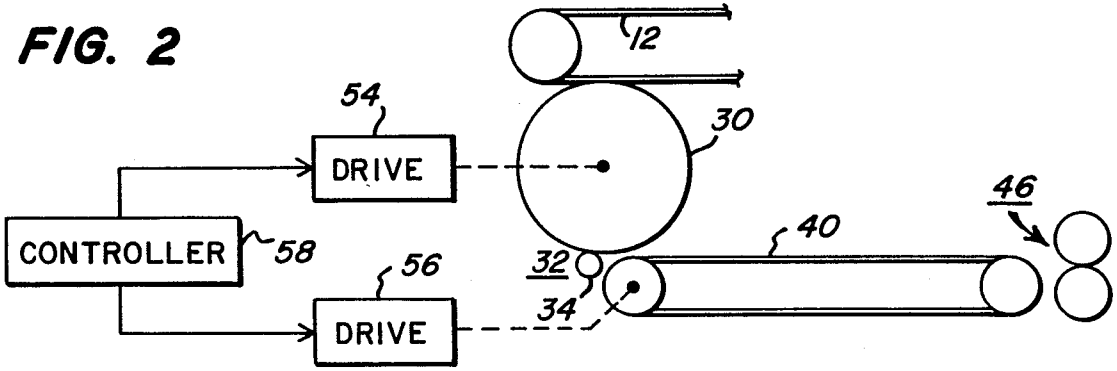
FIG. 2 schematically illustrates the portion of the copier of FIG. 1 which most directly relates to the invention.

FIG. 2 illustrates the portion of the copier shown in FIG. 1, in schematic form, which most directly relates to the invention. According to FIG. 2, the intermediate transfer drum 30 is rotated by the drive 54, and the conveyor belt 40 is rotated or moved by the drive 56. Both drives 54 and 56 are appropriately synchronized with each other and controlled by the system controller 58 In normal one-up operation where only one copy is produced at a time from the transfer station 32, the speed of movement or rotation of the conveyor belt 40 would be constant during the entire process of making multiple copies. However, when multiple copies are made with a multiple-up process, the speed and/or movement of the conveyor belt 40 is changed, according to this invention, depending upon the proximity of the copy sheets to the fuser station 46.

In the specific embodiment shown in FIG. 2, which is the two-up case, the conveyor belt 40 conveys the two copies produced by the transfer station 32 to the fuser station in a normal manner. The conveyor 40 has an effective length long enough to contain two of the smaller sized copy sheets without overlap. After the first of the two copies is delivered to the fuser station by the belt 40, the belt is stopped, thereby preventing the delivery of the second sheet to the fuser station for a predetermined period of time. After this time period, the belt 40 resumes rotation, as determined by the controller 58, and delivers the second copy sheet to the fuser station 46. The belt 40 can continue to rotate until the first copy of the next set of copies is delivered to the fuser station. At that time, the process is repeated wherein the conveyor belt stops for a predetermined period of time. The net result is that the copies delivered to the fuser, and as a result thereof to the output tray of the copier, are done so at a constant output rate as observed by the machine operator.

Figure 3:
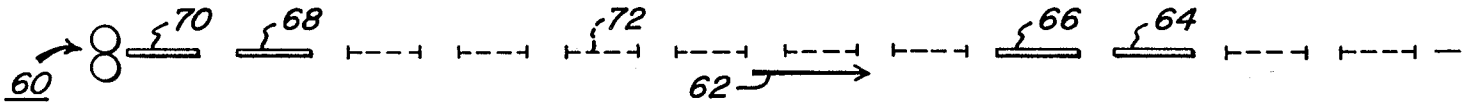
FIG. 3 (PRIOR ART)
FIG. 3 is a diagram illustrating a sheet output rate according to the prior art.

FIG. 3 is a diagram which illustrates a sheet output rate according to the prior art. According to FIG. 3, the sheets are output from the fuser station 46 from a two-up color copier according to the indicated sequence. In other words, the progression of copies moves in direction 62 so that copy sheets 64 and 66 were produced earlier in time from copy sheets 68 and 70. The time between producing copies 66 and 68 is, as previously discussed, due to the time to create, develop, and transfer separate color image frames to the copy sheets. For the equipment shown in FIG. 1, six image frame time periods, such as image frame 72, are needed between the last output sheet of the prior transfer and the first output sheet of the subsequent transfer. Thus, as can be seen from FIG. 3, the copier provides two copy sheets in quick succession with a relatively large time period between the next set of two copy sheets.

Figure 4:
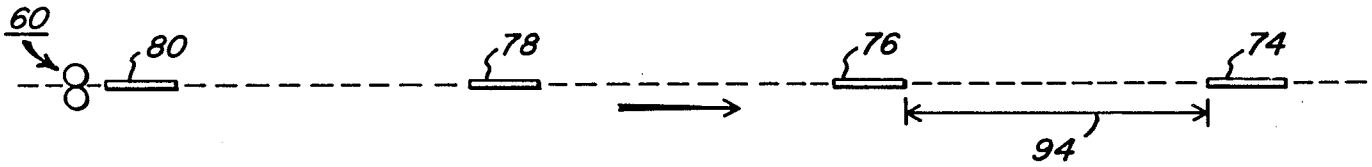
FIG. 4 is a diagram illustrating the constant sheet output rate provided by the timing system of this invention.

FIG. 4 represents a modification of the timing of the output sheets according to this invention. Output sheets 74 and 76 were produced on the same two-up transfer cycle but exit the fuser 46 at substantially different times. Also, copies 78 and 80 were made during a subsequent transfer to a set of two copies and are also spaced in time as shown. The net result is that all of the copies arrive at the output tray with the same time gap there-between, even though they were produced at the transfer station with the timing sequence which provided the output rates shown in FIG. 3. As discussed in connection with FIG. 2, providing the output, or constant output rate, shown in FIG. 4 is accomplished by varying the speed and/or stopping the conveyor belt 40 which transports the copy sheets between the transfer station and the fuser station.

Figure 5:
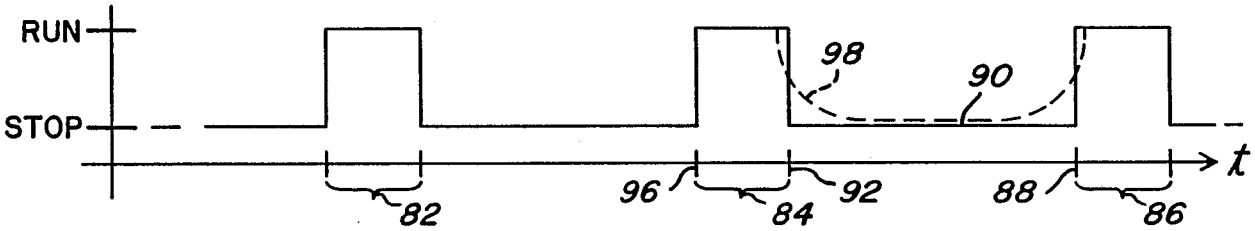
FIG. 5 is a diagram illustrating the timing control of the conveyor according to this invention.

FIG. 5 represents the motion or speed of the conveyor belt 40 which will produce the desired output shown in FIG. 4. According to FIG. 5, the conveyor is running during time intervals 82, 84 and 86. On the other hand, the conveyor is stopped or not running during the other time periods according to the solid portion of the graph or, according to the dashed portion of the graph, the speed is changed. As an example, the conveyor is running during time period 86 to deliver the first of the two sheets in the two-up transfer set. After this delivery and at time instant 88, the conveyor is stopped, according to line 90, for the time period between time 88 and time 92. This corresponds substantially to the time period 94 shown in FIG. 4. At time 92, the conveyor begins running again and feeds the next sheet into the fuser station. At time 96, the conveyor stops again to effectively allow the transfer station to catch up with supplying another set of copies to the conveying system.

In a two-up system, the stopped time of the conveyor, that is, the time period between times 88 and 92 shown in FIG. 5, is equal essentially to one-half the time between successive cycles of the transfer station in supplying a set of two copy sheets. Therefore, in effect, by jogging or slowing the transport system to one-half the average copy output rate of the transfer station, the copy delivery rate to the fuser station can be maintained at a constant rate. When used herein, the term "constant" means that each sheet produced by the station is separated in time from the previous and subsequent sheet by an equal amount. A non-constant output or delivery rate means that the sheets are produced in sets with a small gap between copies in the same set and a large gap of time between the sets. Of course, the long term average output of the sheets from both the transfer station and the fuser station is constant regardless of the motion of the conveyor belt.

The dashed line 98, shown in FIG. 5, indicates that another embodiment of the invention can be used wherein the speed of the conveyor belt is changed between the copies of the individual set. In other words, instead of changing the speed to stop the conveyor completely, the same result can be obtained by slowing the conveyor to another speed at the appropriate time. The dashed line 98 shown in FIG. 5 represents only one cycle of operation. Other dashed lines would be shown to accurately represent this embodiment being used for each sheet set. Whether stopping completely or slowing the rotation of the belt is employed to provide the features of this invention, it is the speed of the conveyor belt which is changed at the appropriate time in synchronization with the output of the transfer station which provides the benefits of this invention.

There has been disclosed herein a new and novel arrangement for delivering output copies at a constant rate from the machine even though they are produced by the transfer station of the machine at a non-constant rate. It is emphasized that numerous changes may be made in the above-described system without departing from the teachings of the invention. It is intended that all of the matter contained in the foregoing description, or shown in the accompanying drawings, shall be interpreted as illustrative rather than limiting.

I claim as my invention:

1. A sheet transport system for use with printers, copiers, and like devices which have a transfer station where developed images are transferred to a sheet medium, and a fusing station where the transferred images are fused to the sheet medium, said transport system comprising:

means for conveying the sheet from the transfer station to the fuser station;

means for controlling the movement of said conveying means; and means for synchronizing the converging means with the delivery of sheets from the transfer station such that the delivery of sheets to said fuser station is at a constant rate even when the transfer station delivers sheets at a non-constant rate.

2. The transport system of claim 1 wherein the controlling means varies the speed of the conveying means to maintain the constant sheet delivery rate.

3. The transport system of claim 1 wherein the controlling means intermittently stops the conveying means to maintain the constant sheet delivery rate.

4. The transport system of claim 1 wherein the conveying means has an effective length long enough to contain at least two of the output sheets simultaneously.

5. The transport system of claim 1 wherein the transfer station includes a movable member with an effective transfer surface at least as large as two of the output sheets.

6. The transport system of claim 4 wherein;

the transfer station has at least two modes of operation, with a first mode transferring images two output sheets during one cycle of movement of the transfer station, and with a second mode not transferring any images to output sheets during at least one cycle of movement of the transfer station, said transfer station operation being interchangeable between said first and second modes; and the conveying means is temporarily stopped after the first and before the second of the two output sheets is delivered to the fuser station.

7. The transport system of claim 6 wherein the temporarily stopped time is substantially equal to one-half the time duration of the second mode of operation.

8. A sheet transport system for use with printers, copiers, and like devices which have a transfer station where developed images are transferred to a sheet medium, and a fusing station where the transferred images are fused to the sheet medium, said transport system comprising:

means for conveying the sheet from the transfer station to the fuser station, said conveying means having an effective length equal to at least two of the output sheets; and means for controlling the movement of said conveying means;

said transfer station including a rotatable member with an effective transfer surface at least as large as two of the output sheets;

said transfer station having first and second modes of transfer wherein, in the first mode, images are transferred to two output sheets during one rotation of the rotatable member and, in the second mode, no images are transferred to output sheets during one or more rotations of the rotatable member, with said transfer station operation alternating between said first and second modes; and said controlling means temporarily stopping the conveying means after the first and before the second of the two output sheets enters the fusing station so that the output of sheets from said fusing station is at a constant rate even when the transfer station delivers sheets at a non-constant rate.

9. The transport system of claim 8 wherein the temporarily stopped time is substantially equal to one-half the time duration of the second mode of operation.

10. A sheet transport system for use with color capable printers, copiers, and like devices which have an intermediate transfer member from which developed images are transferred to a sheet medium, and a fusing station where the transferred images are fused to the sheet medium, said transport system comprising:

means for conveying the sheet from the transfer station to the fuser station, said conveying means having an effective length sufficient to contain two of the output sheets without overlap; and means for controlling the movement of said conveying means;

said intermediate transfer member having an effective transfer surface length substantially equal to the effective length of the conveying means;

said intermediate transfer member having, when the device is operating to provide multiple color outputs, first and second modes of transfer wherein, in the first mode, images are transferred to two output sheets during one cycle of movement of the intermediate transfer member and, in the second mode, no images are transferred to output sheets during a plurality of cycles of movement of the intermediate transfer member, with said transfer operation alternating between said first and second modes; and said controlling means temporarily stopping the conveying means after a first and before the second of the two output sheets on the conveying means enters the fusing station so that the output of sheets from said fusing station is at a constant rate even when the intermediate transfer member delivers images at a non-constant rate.

11. A method of transporting sheets in a color copier or printer between a transfer station which outputs sheets at a non-constant rate and a fuser station, said method including the steps of:

placing sheets from the transfer station onto a conveyor means at a non-constant rate;

changing the speed of the conveying means; and delivering the sheets to the fuser station at a constant rate.

12. A method of transporting sheets in a color copier or printer between a transfer station which outputs sheets at a non-constant rate and a fuser station, said method including the steps of:

placing first and second sheets onto a conveying means;

running the conveying means at a predetermined speed to deliver the first sheet to the fuser station;

then lowering the speed of the conveying means to increase the time needed for the second sheet to reach the fuser station; and resuming the predetermined speed of the conveying means after the second sheet has been delivered to the fuser station.

* * * * *

UNITED STATES PATENT AND TRADEMARK OFFICE

CERTIFICATE OF CORRECTION

PATENT NO. : 4,931,842

DATED : June 5, 1990

INVENTOR(S) : Gregory P. Mahoney

It is certified that error appears in the above-identified patent and that said Letters Patent is hereby corrected as shown below:

Column 6, line 15, the word "converging" should be ---conveying---.

Column 6, line 11, "controlling" changed to ---conveying---

Signed and Sealed this

Sixteenth Day of July, 1991

*Attest:*

*Attesting Officer*

HARRY F. MANBECK, JR.

*Commissioner of Patents and Trademarks*